US009023465B2

(12) United States Patent
Yamada et al.

(10) Patent No.: US 9,023,465 B2
(45) Date of Patent: May 5, 2015

(54) ELECTROCONDUCTIVE MEMBER, PROCESS CARTRIDGE AND ELECTROPHOTOGRAPHIC IMAGE FORMING APPARATUS

(75) Inventors: Satoru Yamada, Numazu (JP); Seiji Tsuru, Susono (JP); Kazuhiro Yamauchi, Suntou-gun (JP); Norifumi Muranaka, Mishima (JP); Yuka Hirakoso, Kounosu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/246,828

(22) Filed: Sep. 27, 2011

(65) Prior Publication Data

US 2012/0020700 A1 Jan. 26, 2012

Related U.S. Application Data

(63) Continuation of application No. PCT/JP2011/003177, filed on Jun. 6, 2011.

(30) Foreign Application Priority Data

Jun. 30, 2010 (JP) ..... 2010-150562

(51) Int. Cl.

| | |
|---|---|
| ***G03G 15/00*** | (2006.01) |
| ***G03G 15/08*** | (2006.01) |
| ***G03G 15/02*** | (2006.01) |

(52) U.S. Cl.

CPC ..... *G03G 15/0818* (2013.01); *G03G 15/0233* (2013.01)

(58) Field of Classification Search

CPC .. H01B 1/122; H01M 8/1037; H01M 8/1048; G03G 15/0818; G03G 15/0233

USPC ..... 428/323; 399/111, 115, 119

See application file for complete search history.

(56) References Cited

U.S. PATENT DOCUMENTS

| | | | | |
|---|---|---|---|---|
| 3,558,360 | A * | 1/1971 | Sverdrup et al. | 429/487 |
| 5,822,646 | A * | 10/1998 | Kinoshita et al. | 399/24 |
| 6,127,622 | A | 10/2000 | Yamada et al. | |

(Continued)

FOREIGN PATENT DOCUMENTS

| | | | |
|---|---|---|---|
| JP | 2001-305832 | A | 11/2001 |
| JP | 2003-12935 | A | 1/2003 |

(Continued)

OTHER PUBLICATIONS

Yamada, et al., U.S. Appl. No. 13/246,828, filed Sep. 27, 2011.

(Continued)

*Primary Examiner* — Elizabeth A Robinson

(74) *Attorney, Agent, or Firm* — Fitzpatrick, Cella, Harper and Scinto

(57) ABSTRACT

Provided is an electroconductive member that can demonstrate stable performance for a long period of time with an electric resistance value being hardly changed even by electrical conduction for a long period of time. An electroconductive member has a conductive mandrel, and a conductive layer provided on the outer periphery of the conductive mandrel. The conductive layer includes an organic polymeric compound as a binder, and a conductive particle dispersed in the organic polymeric compound, and the particle includes an organic-inorganic hybrid polymer having a specific structure.

8 Claims, 2 Drawing Sheets

(56) References Cited

U.S. PATENT DOCUMENTS

| | | | | |
|---|---|---|---|---|
| 7,488,559 | B2 * | 2/2009 | Inagaki et al. | 429/317 |
| 7,947,339 | B2 | 5/2011 | Yamauchi et al. | |
| 2003/0083411 | A1 | 5/2003 | Sugiura et al. | |
| 2010/0104316 | A1 | 4/2010 | Hoshio et al. | |

FOREIGN PATENT DOCUMENTS

| | | | | |
|---|---|---|---|---|
| JP | 2003-221474 | A | | 8/2003 |
| JP | 2005-114748 | A | | 4/2005 |
| JP | 2006040853 | A | * | 2/2006 |

OTHER PUBLICATIONS

PCT International Search Report and Written Opinion of the International Searching Authority, International Application No. PCT/JP2011/003177, Mailing Date Jun. 28, 2011.

English translation of International Preliminary Report on Patentability, International Application No. PCT/JP2011/003177, Mailing Date Feb. 21, 2013.

Chinese Office Action dated Oct. 30, 2014 in Chinese Application No. 201180032312.5.

* cited by examiner

ELECTROCONDUCTIVE MEMBER, PROCESS CARTRIDGE AND ELECTROPHOTOGRAPHIC IMAGE FORMING APPARATUS

CROSS-REFERENCE TO RELATED APPLICATIONS

This application is a continuation of International Application No. PCT/JP2011/003177, filed Jun. 6, 2011, which claims the benefit of Japanese Patent Application No. 2010-150562, filed Jun. 30, 2010.

BACKGROUND OF THE INVENTION

1. Field of the Invention

The present invention relates to an electroconductive member used for an electrophotographic image forming apparatus, a process cartridge and an electrophotographic image forming apparatus.

2. Description of the Related Art

In the electrophotographic image forming apparatus, a charging roller used for a contact charging method is known in which a conductive elastic layer containing an ion conductive agent as a conductive material is formed on the outer periphery of the conductive mandrel. Unfortunately, the conductive elastic layer given conductivity by the ion conductive agent has a problem. Namely, in order to improve the conductivity by the ion conductive agent, a large amount of the ion conductive agent needs to be added to the conductive elastic layer. Moreover, in the case where a large amount of the ion conductive agent is added, the ion conductive agent may bleed out to the surface of the conductive elastic layer under high temperature and humidity. For such problems, Japanese Patent Application Laid-Open No. 2003-012935 proposes use of a quaternary ammonium salt represented by the following formula (14) as the ion conductive agent.

(14)

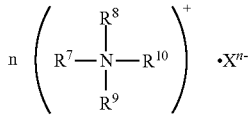

wherein $R^7$, $R^8$, $R^9$ and $R^{10}$ represent an alkyl group, at least one of these is different from the other, and at least one of these represents an alkyl group having 4 to 8 carbon atoms; $n^-$ represents an anion of n valence, and n represents an integer of 1 to 6.

In the disclosure of Japanese Patent Application Laid-Open No. 2003-012935, bleed out of the ion conductive agent to the surface of the conductive elastic layer can be suppressed because in the conductive elastic layer containing the quaternary ammonium salt represented by the above formula (14) as the ion conductive agent, even a small amount of the ion conductive agent to be added can give high conductivity to a conductive elastic layer.

SUMMARY OF THE INVENTION

The present inventors, however, found out that along with a more variety of environments in which the electrophotographic image forming apparatus is used recently, it is necessary to further suppress increase in the electric resistance value of the charging member accompanied by use of the electrophotographic image forming apparatus under severe environments and reduction in image quality of an electrophotographic image attributed to the increased electric resistance value.

Then, the present invention is directed to provide an electroconductive member that can demonstrate stable performance for a long period of time with an electric resistance value being hardly changed even if DC voltage is applied for a long period of time. Further, the present invention is directed to provide a process cartridge and electrophotographic image forming apparatus that stably form an electrophotographic image with high quality.

According to one aspect of the present invention, there is provided an electroconductive member comprising a conductive mandrel and a conductive layer provided on the outer periphery of the conductive mandrel, wherein the conductive layer comprises an organic polymeric compound as a binder and a conductive particle dispersed in the organic polymeric compound, and the particle comprises an organic-inorganic hybrid polymer having a structure represented by the following formula (1).

(1)

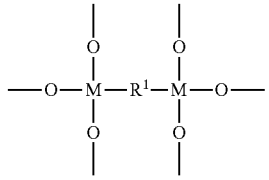

wherein $R^1$ represents an organic group having an ion exchange group; M represents silicon, titanium, zirconium or hafnium.

According to another aspect of the present invention, there is provided a process cartridge composed so as to be detachable to a main body of an electrophotographic image forming apparatus, and comprising the electroconductive member as a charging roller or developing roller.

According to yet another aspect of the present invention, there is provided an electrophotographic image forming apparatus comprising the electroconductive member as a charging roller or developing roller.

According to the present invention, an ion exchange group is chemically fixed within a molecule of a compound that forms a conductive particle, thereby to suppress movement of the ion exchange group over time. Thereby, an electroconductive member for electrophotography can be obtained whose electric resistance value is hardly changed even if a DC voltage is applied for a long period of time. Moreover, the present invention can provide a process cartridge and electrophotographic image forming apparatus that can stably provide an electrophotographic image with high quality for a long period of time.

Further features of the present invention will become apparent from the following description of exemplary embodiments with reference to the attached drawings.

DESCRIPTION OF THE EMBODIMENTS

The electroconductive member according to the present invention can be used as a charging member (charging roller), a developing member (developing roller), a transfer member, a discharging member, and a conveying member such as a sheet feeding roller in an electrophotographic image forming apparatus. In the description below, the present invention will be described using an example of the charging roller.

Figure 1:
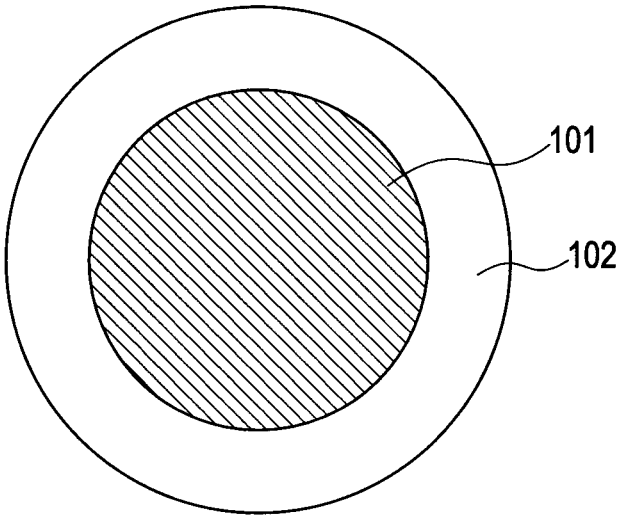
FIG. 1 is a drawing showing a schematic configuration of a charging roller according to the present invention.
Figure 2:
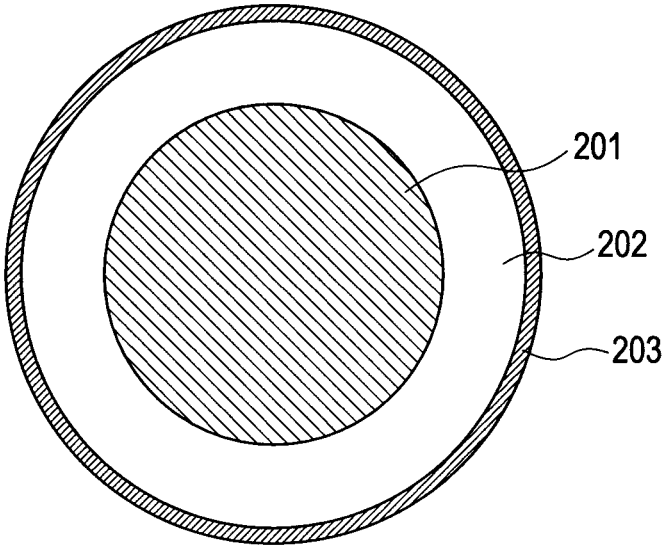
FIG. 2 is a drawing showing a schematic configuration of a charging roller according to the present invention.

FIG. 1 is a sectional view of a mandrel 101 in a charging roller according to the present invention in a direction intersecting perpendicular to the mandrel. The outer periphery of the conductive mandrel 101 includes a conductive layer 102. As shown in FIG. 2, the conductive layer may be formed of a plurality of layers 202 and 203.

(Conductive Mandrel)

The conductive mandrels 101 and 201 have conductivity in order to feed electricity to the surface of the charging roller through the mandrel.

(Conductive Layer)

The conductive layers 102, 202 and 203 include an organic polymeric compound as a binder and a conductive particle dispersed in the organic polymeric compound. As shown in FIG. 2, in the case of a plurality of the conductive layers, one of the layers may include an organic polymeric compound as a binder and a conductive particle dispersed in the organic polymeric compound. Alternatively, all the layers may include an organic polymeric compound as a binder and a conductive particle dispersed in the organic polymeric compound.

(Binder)

As the binder, rubbers, elastomers and resins can be used.

Specific examples of the rubbers include: ethylene-propylene-diene copolymers (EPDM), polybutadiene, natural rubbers, polyisoprene, styrene-butadiene rubbers (SBR), chloroprene (CR), acrylonitrile-butadiene rubbers (NBR), silicone rubbers, urethane rubbers, and epichlorohydrin rubbers. Moreover, specific examples of the resins and elastomers include: polystyrene polymer materials such as butadiene resins (RB), polystyrene, styrene-butadiene-styrene elastomers (SBS), and styrene-vinyl acetate copolymers; polyolefin polymer materials such as polyethylene (PE) and polypropylene (PP); polyester polymer materials; polyurethane polymer materials; acrylic polymer materials such as acrylic resins and butadiene-acrylonitrile copolymers; and thermoplastic elastomers such as PVC and RVC. One of these may be used, or two or more thereof may be used in combination as a mixture. Among these, epichlorohydrin rubbers, NBR, polyether copolymers, and a mixture of two or more of these are preferred because a desired conductivity can be stably obtained.

Specific examples of the epichlorohydrin rubbers can include: epichlorohydrin homopolymers, epichlorohydrin-ethylene oxide copolymers, epichlorohydrin-allyl glycidyl ether copolymers, and epichlorohydrin-ethylene oxide-allyl glycidyl ether terpolymers.

(Conductive Particle)

The conductive particle includes an organic-inorganic hybrid polymer, and the organic-inorganic hybrid polymer has a structure represented by the following formula (1).

(1)

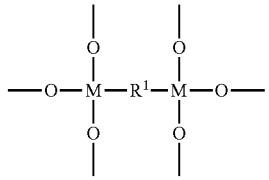

In the formula (1), M is one selected from the group consisting of silicon, titanium, zirconium or hafnium. $R^1$ represents an organic group having an ion exchange group. Apparently from the above formula (1), in the organic-inorganic hybrid polymer that forms the conductive particle, the organic group $R^1$ having an ion exchange group, which contributes to development of the conductivity, is directly bonded to the atom M by chemical bond. Accordingly, no ion exchange group easily moves even if DC potential is applied to the charging roller. For this reason, the charging roller according to the present invention suppresses increase in the electric resistance value over time. In the formula (1), if the atom M is Si, Ti, Zr or Hf, the organic-inorganic hybrid polymer has higher dispersibility, and can exist in the binder more stably. Particularly preferred is Si because it has less interaction with the binder.

Moreover, in the above formula (1), $R^1$ is preferably an organic group represented by the following formula (2), (3), (4), (5) or (6). Particularly preferred for heat resistance is the structure represented by the formula (3), (4), (5) or (6) and having a benzene ring bonded to M or C bonded to M at two locations.

(2)

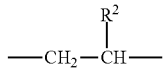

wherein $R^2$ represents an organic group having a sulfonate group, a phosphate group, a carboxyl group or a quaternary ammonium group.

(3)

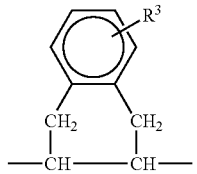

(4)

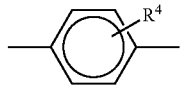

(5)

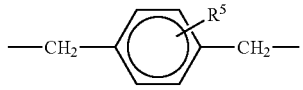

(6)

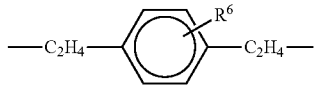

In the formulas (3), (4), (5) and (6), $R^3$, $R^4$, $R^5$ and $R^6$ each independently represent an organic group having a sulfonate group, a phosphate group or a carboxyl group. Examples of the ion exchange group having $R^2$, $R^3$, $R^4$, $R^5$ or $R^6$ in the organic group in the formula (2), (3), (4), (5) or (6) include a sulfonate group, a phosphate group, a carboxyl group, and a quaternary ammonium group. More preferred as the ion exchange group is a sulfonate group because even a small amount of the conductive particle to be added can provide the conductive layer having a desired electric resistance value. The particle size of the conductive particle is not less than 25 nm and not more than 500 nm. The amount of the conductive particle to be mixed is not less than 5 parts by mass and not more than 50 parts by mass based on 100 parts by mass of the binder.

The organic-inorganic hybrid polymer according to the present invention can be synthesized as follows: a hydrolyzed condensate of a hydrolytic compound containing at least one selected from the group consisting of compounds represented by the following formula (7), (8), (9) or (10) is synthesized; then, operation such as introduction of the ion exchange group into $R^7$ is performed to provide $R^1$.

$$(OR)_3Si—R^7—Si(OR)_3 \quad (7)$$

$$(OR)_3Ti—R^7—Ti(OR)_3 \quad (8)$$

$$(OR)_3Zr—R^7—Zr(OR)_3 \quad (9)$$

$$(OR)_3Hf—R^7—Hf(OR)_3 \quad (10)$$

In the above formulas (7), (8), (9) and (10), $R^7$ represents an organic group that can be converted into $R^1$, which is a group having an ion exchange group. Specifically, examples thereof include a vinylene group represented by the following formula (11) or a phenylene group.

$$—C{=}C— \quad (11)$$

For example, in the case where $R^7$ is a vinylene group represented by the above formula (11), the ion exchange group $R^2$ can be added to the vinylene group to form a structure represented by the above formula (2). Moreover, benzocyclobutene can be reacted with double bond of the vinylene group, and then an ion exchange group such as a sulfonate group can be introduced into the benzene ring to form a structure represented by the above formula (3). Further, in the case where $R^7$ is a phenylene group, an ion exchange group such as a sulfonate group can be introduced into the benzene ring to form a structure represented by the above formula (4). In the above formulas (7) to (10), R each independently represents a hydroxyl group or an alkyl group having 1 to 4 carbon atoms.

The organic-inorganic hybrid polymer according to the present invention can be produced by the following method, for example. First, an organic-inorganic hybrid polymer without an ion exchange group is produced. For example, in the case where the organic-inorganic hybrid polymer according to the present invention is obtained in which M is Si and $R^1$ is represented by the formula (2) or (3), 1,2-bis(triethoxysilyl) ethene is polycondensed. Moreover, in the case where the organic-inorganic hybrid polymer according to the present invention is obtained in which M is Si and $R^1$ is represented by the formula (4), 1,2-bis(triethoxysilyl)benzene is polycondensed.

Similarly, in the case where the organic-inorganic hybrid polymer according to the present invention is obtained in which M is Si and $R^1$ is represented by the formula (5) or (6), 1,2-bis(trimethoxysilylmethyl)benzene or 1,2-(trimethoxysilylethyl)benzene is polycondensed, respectively.

At this time, in addition to the compound, tetraalkoxysilanes such as tetraethoxysilane, tetraalkoxytitanium, tetraalkoxyzirconium, or tetraalkoxyhafnium may be mixed for polycondensation. Tetraalkoxysilanes are added in order to adjust the electric resistance value of the organic-inorganic hybrid polymer. The organic-inorganic hybrid polymer obtained by polycondensation in the copresence of tetraalkoxysilane or the like includes the structure represented by $SiO_{4/2}$ within a molecule. A specific example is represented by the structure formula (12) below.

(12)

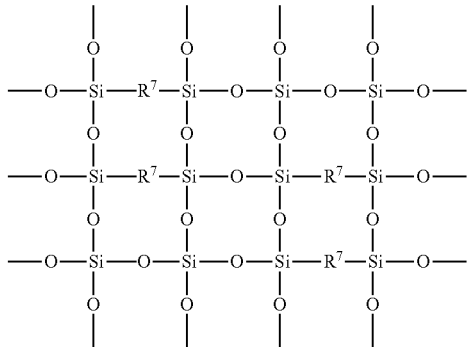

The reaction temperature in polycondensation is preferably not less than 0° C. and not more than 100° C. A lower temperature is more advantageous in order to enhance regularity of the structure. On the other hand, a higher temperature increases a polymerization degree. In order to enhance the regularity of the structure and increase the polymerization degree, a reaction temperature of not less than 20° C. and not more than 80° C. is more preferred. The reaction solution in polycondensation preferably has a pH of not less than 7. At a pH less than 7, the hydrolysis reaction of an alkoxy group is accelerated, while the speed of the polymerization reaction is reduced.

Further, in the case of $R^1$ represented by the formula (3), benzocyclobutene is reacted with a polycondensate of 1,2-bis (triethoxysilyl)ethene.

Subsequently, the ion exchange group is introduced into an organic-inorganic hybrid polymer without an ion exchange group. Examples of a method for introducing an ion exchange group include any method including known methods. For example, in the case where the ion exchange group is a sulfonate group, a sulfonating agent such as chlorosulfonic acid, sulfuric anhydride and fuming sulfuric acid is used. In the case where the ion exchange group is a phosphoric acid, examples of the method for introducing an ion exchange group include a method in which chloromethylation is performed, and triethyl phosphite is reacted for hydrolysis, and a method by treatment by a phosphorylating agent such as phosphorus oxychloride. In the case where the ion exchange group is a carboxyl group, examples of the method for introducing an ion exchange group include a method for introducing an organic group such as a methyl group, and oxidizing the methyl group.

A specific example of the structure of the organic-inorganic hybrid polymer according to the present invention to be thus obtained is represented by the following formula (13):

(13)

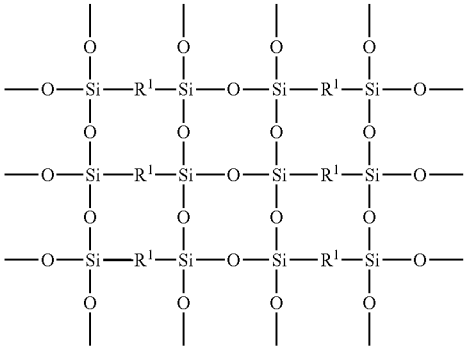

The conductive layer may contain other compounding agents when necessary in such a range that the compounding agents do not inhibit the function of the substance. Examples of the compounding agent can include fillers, plasticizers, vulcanizing agents, acid receiving agents, antioxidants, vulcanization delaying agents, and processing aids.

(Surface Layer)

A surface layer can be provided on the surface of the conductive layer. The surface layer is provided in order to satisfy functionality needed as the charging roller. For example, adjustment of the electric resistance value or the like is included. Known surface layers can be used, and examples thereof include those including a binder, a conductive agent, a roughening agent, and an insulative inorganic fine particle.

As the binder for the surface layer, resins such as thermosetting resins and thermoplastic resins are used. Examples thereof include urethane resins, fluororesins, silicone resins, acrylic resins, and polyamide resins. Urethane resins obtained by crosslinking lactone-modified acrylic polyol with isocyanate are particularly suitably used.

Examples of the conductive agent include conductive particles of carbon black, graphite, conductive metal oxides of conductive titanium oxide and conductive tin oxide, and the like, or conductive composite particles of these conductive particles and other particles. A proper amount of these can be dispersed to obtain a desired electric resistance value.

The roughening agent can form fine depressions and projections on the surface of the charging member to improve uniformity of charging. The fine depressions and projections on the surface are particularly effective in the DC charging method. As the roughening agent, fine particles including a polymeric compound such as urethane fine particles, silicone fine particles and acrylic fine particles are preferably used.

(Electrophotographic Image Forming Apparatus)

Figure 3:
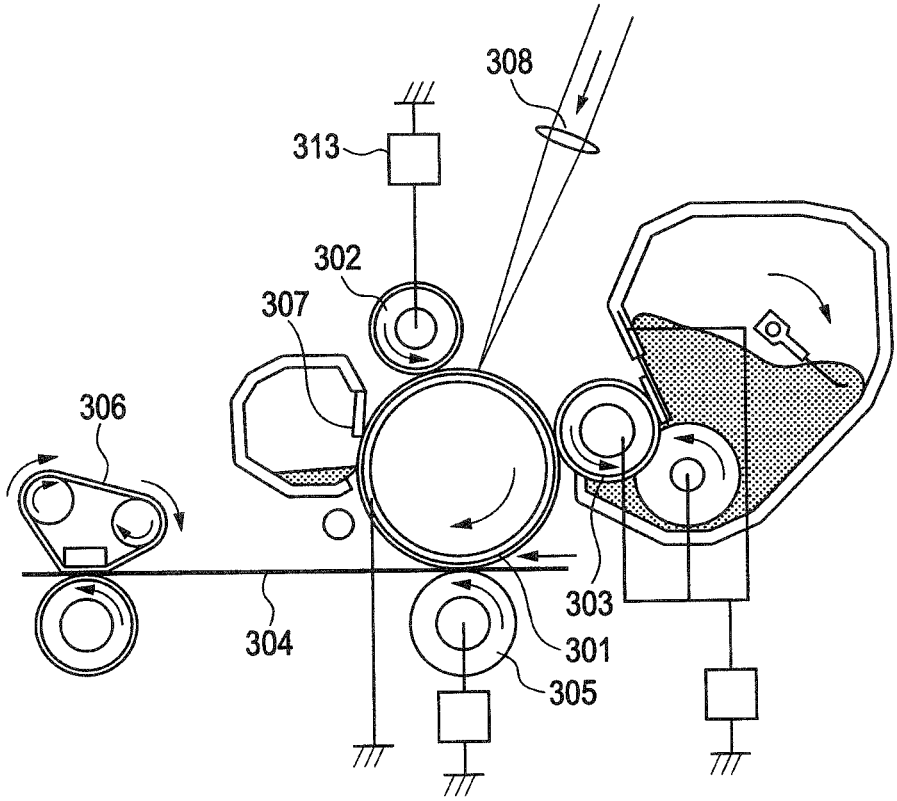
FIG. 3 is a schematic view of an electrophotographic image forming apparatus using the charging roller according to the present invention.

FIG. 3 is a schematic view of an electrophotographic image forming apparatus using the charging roller according to the present invention. The electrophotographic image forming apparatus includes a charging roller 302 that charges an electrophotographic photosensitive member 301, a latent image forming device 308 that performs exposure, a developing device 303 that develops the latent image into a toner image, a transfer device 305 that transfers the toner image onto a transfer material 304, a cleaning device 307 that recovers a transfer toner on the electrophotographic photosensitive member, and a fixing device 306 that fixes the toner image. The electrophotographic photosensitive member 301 is a rotary drum type having a photosensitive layer on a conductive base. The electrophotographic photosensitive member 301 is driven to be rotated in the arrow direction at a predetermined circumferential speed (process speed). The charging roller 302 is pressed against to the electrophotographic photosensitive member 301 at a predetermined force to be arranged in contact with the electrophotographic photosensitive member 301. The charging roller 302 is rotated following the rotation of the electrophotographic photosensitive member 301. When a charging power supply 313 applies a predetermined DC voltage to the charging roller 302, the charging roller charges the electrophotographic photosensitive member 301 at a predetermined potential. As the latent image forming device 308 that forms a latent image on the electrophotographic photosensitive member 301, an exposing device such as a laser beam scanner is used, for example. The latent image forming device 308 exposes the uniformly charged electrophotographic photosensitive member 301 according to the image information to form an electrostatic latent image. The developing device 303 has a contact-type developing roller arranged in contact with the electrophotographic photosensitive member 301. The developing device 303 develops the electrostatic latent image into a visible toner image by reversal development of the toner electrostatically processed to have the same polarity as that of the charged photosensitive member. The transfer device 305 has a contact-type transfer roller. The transfer device 305 transfers the toner image from the electrophotographic photosensitive member 301 onto the transfer material 304 such as plain paper. The transfer material 304 is conveyed by a sheet feeding system having a conveying member. The cleaning device 307 has a blade-like cleaning member and a recover container, and after transfer, mechanically scrapes the transfer remaining toner left on the electrophotographic photosensitive member 301 and recovers the toner. Here, if a developing simultaneous cleaning method is used in which the developing device 303 recovers the transfer remaining toner, the cleaning device 307 can be eliminated. The fixing device 306 includes a heated roller, and fixes the transferred toner image onto the transfer material 304 to discharge the transfer material to the outside of the apparatus.

(Process Cartridge)

Figure 4:
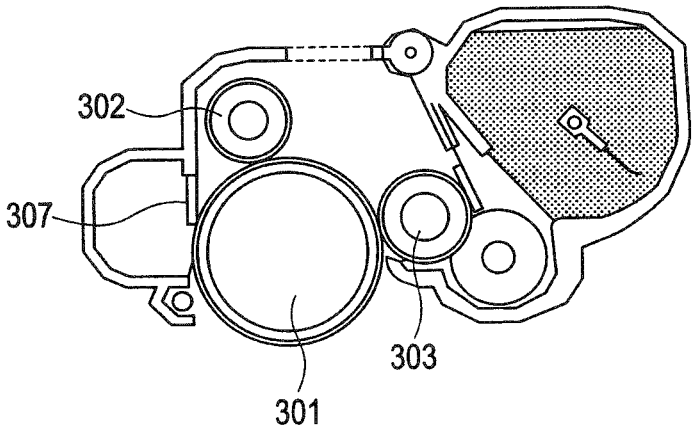
FIG. 4 is a schematic view of a process cartridge using the charging roller according to the present invention.

As shown in FIG. 4, a process cartridge can be used which is designed so that the electrophotographic photosensitive member 301, the charging roller 302, the developing device 303, the cleaning device 307 and the like are integrated into one to be detachably attached to the image forming apparatus.

EXAMPLES

Hereinafter, the present invention will be specifically described according to Examples. A method for evaluating a charging roller and a developing roller in Examples is as follows.

<1. Evaluation of Charging Roller>

(1) Measurement of Electric Resistance Value (at Initial Stage and after Durability Test)

Under the environment at a temperature of 23° C. and a humidity of 50% RH, the charging roller was put in contact with a metal drum (load of 4.9 N applied to each end), and a voltage of DC 200 V was applied between the conductive mandrel (hereinafter, referred to as a "mandrel" in some cases) and a metal drum. An electric resistance value as the value at the initial stage was determined, and evaluated on the following criterion:

A: the electric resistance value is less than $1.0\times10^5\Omega$,

B: the electric resistance value is not less than $1.0\times10^5\Omega$ and less than $2.0\times10^5\Omega$, C: the electric resistance value is not less than $2.0\times10^5\Omega$ and less than $4.0\times10^5\Omega$, and D: the electric resistance value is not less than $4.0\times10^5\Omega$.

Next, the charging roller measured was subjected to a durability test using the apparatus used for the measurement of the electric resistance value mentioned above. Specifically, while the metal drum was rotated at 30 rpm, a DC current of 450 μA was applied between the mandrel and the metal drum for 30 minutes. Then, in the same manner as above, the electric resistance value after the durability test was measured, and evaluated on the above criterion.

(2) Evaluation of Image at the Initial Stage

As the electrophotographic image forming apparatus, an electrophotographic laser printer (trade name: LBP5400, made by Canon Inc.) was modified to have an output speed of 250 mm/sec for A4 size paper and an image resolution of 600 dpi. On the electrophotographic image forming apparatus, each of the charging rollers of Examples and Comparative Examples was mounted, and an electrophotographic image was formed. The electrophotographic image was output at a low temperature and humidity (temperature of 15° C., humidity of 10%). The electrophotographic image to be output was a halftone image (image having a horizontal line drawn perpendicular to the rotating direction of the photosensitive drum at a width of 1 dot and an interval of 2 dots). The obtained electrophotographic image was visually observed, and evaluated on the following criterion:

A: no horizontal streaks are observed,

B: slight horizontal streaks are partially observed,

C: slight horizontal streaks are entirely observed, and

D: apparent horizontal streaks are entirely observed.

(3) Evaluation of Image after Durability Test

Using the electrophotographic image forming apparatus, one sheet of an electrophotographic image was output, and then the rotation of the electrophotographic photosensitive member was completely stopped. Again, the image forming operation was restarted. Such an intermittent image forming operation was repeated to output 40000 sheets of the electrophotographic image. Then, the charging roller was taken out from the electrophotographic image forming apparatus. The surface of the charging roller was sprayed with water at a high pressure to be washed, and dried. Then, the charging roller was mounted on the electrophotographic image forming apparatus again. The intermittent image forming operation was repeated to output 40000 sheets of the electrophotographic image. The image output at this time is an image of the "E" letter of the alphabet at a size of 4 points to be printed such that the coverage may be 1% based on an area of a sheet of an A4 size.

After the second round of the output of the 40000 sheets of the image was completed, one sheet of the halftone image was output, and the halftone image was observed and evaluated in the same manner as in (2) above. The evaluation environment was a low temperature and humidity (temperature 15° C., humidity of 10%).

<2. Evaluation of Developing Roller>

(1) Evaluation of Image at Initial Stage

Using the electrophotographic image forming apparatus used for evaluation of the charging roller, a solid (solid) image and a halftone image were output under an environment of a low temperature and humidity (temperature of 15° C., humidity of 10%). The respective images were visually observed, and evaluated on the following criterion:

A: no nonuniformity of the concentration caused by the developing roller is found in the solid image and the halftone image, B: nonuniformity of the concentration caused by the developing roller is found in the solid image, but not found in the halftone image, and C: nonuniformity of the concentration caused by the developing roller is found both in the solid image and the halftone image.

(2) Evaluation of Image after Durability Test

Using the electrophotographic image forming apparatus, one sheet of the electrophotographic image was output, and then the rotation of the electrophotographic photosensitive member was completely stopped. Again, the image forming operation was restarted. Such an intermittent image forming operation was repeated to output 40000 sheets of the electrophotographic image. The image output at this time is an image of the "E" letter of the alphabet at a size of 4 points to be printed such that the coverage may be 1% based on an area of a sheet of an A4 size. After the output of 40000 sheets of the image was completed, a solid image and a halftone image were output. The respective images were visually observed, and evaluated on the following criterion:

A: no nonuniformity of the concentration is found in the solid image and the halftone image, B: nonuniformity of the concentration is found in the solid image, but not in the halftone image, and C: nonuniformity of the concentration is found in the solid image and the halftone image.

<Synthesis of Organic-Inorganic Hybrid Polymers A to W>

First, according to Synthesis Example 1 to Synthesis Example 10, organic-inorganic hybrid polymers without an ion exchange group (Polymer 1 to Polymer 10) were produced. Subsequently, according to Synthesis Example A to Synthesis Example X, organic-inorganic hybrid polymers (Polymer A to Polymer W) obtained by introducing an ion exchange group into these polymers, and Polymer X were produced.

Synthesis Example 1

An aqueous solution was prepared by adding sodium hydroxide to 500 g of ion exchange water and adjusting the pH to 10. To the aqueous solution, 14 g of 1,2-bis(triethoxysilyl)ethene and 2 g of tetraethoxysilane were added. The mixed solution was stirred at 40° C. for 2 hours, the solution after stirring was kept at 97° C. and left for 24 hours. Then, a precipitate was recovered by filtration, and washed by methanol. After washing, the obtained product was dried by the air, and dried at room temperature in vacuum to obtain Polymer 1.

Synthesis Examples 2 to 7

A polymer was obtained in the same manner as in Synthesis Example 1 except that the kinds of Compound 1 and Compound 2 as raw materials and the amounts thereof to be used were changed as shown in Table 1.

1 g of each polymer obtained and 6 g of benzocyclobutene were placed into an autoclave, mixed, and reacted at 210° C. for 30 hours. The reaction product was washed for 6 hours while it was refluxed with 150 ml of chloroform. Washing was performed again in the same manner, and the reaction product after washing was recovered. The recovered product was dried at 80° C. for 6 hours to obtain Polymers 2 to 7.

Synthesis Examples 8 to 10

Polymers 8 to 10 were obtained in the same manner as in Synthesis Example 1 except that the kinds of Compound 1 and Compound 2 as raw materials and the amounts thereof to be used were changed as shown in Table 1.

TABLE 1

| Synthesis | Raw material for polymer | | | | |
|---|---|---|---|---|---|
| | Compound 1 | | Compound 2 | | Post treatment |
| Example | Name | Amount | Name | Amount | — |
| 1 | 1,2-Bis(triethoxysilyl)ethene | 14 | Tetraethoxysilane | 2 | Benzocyclobutene |
| 2 | 1,2-Bis(triethoxysilyl)ethene | 16 | — | — | Benzocyclobutene |
| 3 | 1,2-Bis(triethoxysilyl)ethene | 14 | Tetraethoxysilane | 2 | Benzocyclobutene |
| 4 | 1,2-Bis(triethoxysilyl)ethene | 11 | Tetraethoxysilane | 7 | Benzocyclobutene |
| 5 | 1,2-Bis(triethoxytitanyl)ethene | 16 | Tetraethoxytitanium | 3 | Benzocyclobutene |
| 6 | 1,2-Bis(triethoxyzirconyl)ethene | 13 | Tetraethoxyzirconium | 2 | Benzocyclobutene |
| 7 | 1,2-Bis(triethoxyhafnyl)ethene | 15 | Tetraethoxyhafnium | 2 | Benzocyclobutene |
| 8 | 1,4-Bis(triethoxysilyl)benzene | 16 | Tetraethoxysilane | 2 | — |
| 9 | 1,4-Bis(trimethoxysilylmethyl)benzene | 14 | Tetraethoxysilane | 2 | — |
| 10 | 1,4-Bis(trimethoxysilylethyl)benzene | 15 | Tetraethoxysilane | 2 | — |

Synthesis Example A

Polymer 1 (1 g) was added to 100 ml of concentrated sulfuric acid. Stirring was continued under an argon atmosphere for 72 hours while the mixed solution was heated to 80° C. The obtained reaction product was washed by 500 ml of ion exchange water five times, and dried at 80° C. for hours. The dried reaction product was ground, and classified to obtain Organic-Inorganic Hybrid Polymer A having an average particle size of 79 nm and an introduced ion exchange group.

Synthesis Example B

Polymer 1 (1 g) was added to 100 ml of hydrochloric acid, and stirring was continued for 72 hours. The obtained reaction product was washed by 500 ml of ion exchange water five times. The washed reaction product was added to a phosphorous acid aqueous solution, and the mixed solution was stirred. The obtained reaction product was washed by 500 ml of ion exchange water five times. The washed reaction product was dried at 80° C. for 6 hours. The dried reaction product was ground, and classified to obtain Organic-Inorganic Hybrid Polymer B having an average particle size of 81 nm.

Synthesis Example D

Polymer 1 (1 g) was added to 100 ml of hydrochloric acid, and stirring was continued for 72 hours. The obtained reaction product was washed by 500 ml of ion exchange water five times. The washed reaction product was dispersed in alcohol, and phthalic acid imide potassium salt was added for reaction. The reaction product was dispersed in ethanol, and hydrazine was added for reaction. Washing and treatment with hydrochloric acid were performed. The obtained reaction product was washed by 500 ml of ion exchange water five times. The washed reaction product was dried at 80° C. for 6 hours. The dried reaction product was ground, and classified to obtain Organic-Inorganic Hybrid Polymer D having an average particle size of 81 nm.

Synthesis Examples E to G

A reaction product was produced in the same manner as in Synthesis Example A except that Polymer 2, 3 or 4 was used instead of Polymer 1 of Synthesis Example A. The dried reaction product was ground, and classified to obtain Organic-Inorganic Hybrid Polymers E to G.

Synthesis Examples H and I

A reaction product was produced in the same manner as in Synthesis Example F. The dried reaction product was ground, and classified to obtain Organic-Inorganic Hybrid Polymers H and I.

Synthesis Examples J to L

A reaction product was produced in the same manner as in Synthesis Example A except that Polymer 5, 6 or 7 was used instead of Polymer 1 of Synthesis Example A. The dried reaction product was ground, and classified to obtain Organic-Inorganic Hybrid Polymers J to L.

Synthesis Example M

Polymer 3 (1 g) was treated with chlorine in the presence of iron as a catalyst. The obtained reaction product was washed by ion exchange water. The washed reaction product was added to a phosphorous acid aqueous solution, and the mixed solution was stirred. The obtained reaction product was washed, and dried at 80° C. for 6 hours. The dried reaction product was ground, and classified to obtain Organic-Inorganic Hybrid Polymer M having an average particle size of 79 nm.

Synthesis Examples O and P

A reaction product was produced in the same manner as in Synthesis Example A or Synthesis Example M except that Polymer 8 was used instead of Polymer 1 of Synthesis Example A or Polymer 3 of Synthesis Example M. The dried reaction product was ground, and classified to obtain Organic-Inorganic Hybrid Polymers 0 and P.

Synthesis Examples R to T

A reaction product was produced in the same manner as in Synthesis Example A or Synthesis Example M except that Polymer 9 was used instead of Polymer 1 of Synthesis Example A or Polymer 3 of Synthesis Example M. The dried reaction product was ground, and classified to obtain Organic-Inorganic Hybrid Polymers R, S and T.

Synthesis Examples U and V

A reaction product was produced in the same manner as in Synthesis Example A or Synthesis Example M except that Polymer 10 was used instead of Polymer 1 of Synthesis Example A or Polymer 3 of Synthesis Example M. The dried reaction product was ground, and classified to obtain Organic-Inorganic Hybrid Polymers U and V.

Synthesis Example X

An aqueous solution was prepared by adding sodium hydroxide to 500 g of ion exchange water and adjusting the pH to 10. To the aqueous solution, 14 g of 1,2-bis(trihydroxysilyl)benzenesulfonic acid and 2 g of tetraethoxysilane were added. The mixed solution was stirred at 40° C. for 2 hours. The stirred solution was kept at 97° C. and left for 24 hours. Then, a precipitate was recovered by filtration, and washed by methanol. After washing, the obtained product was dried by the air, and dried at room temperature in vacuum to obtain Organic-Inorganic Hybrid Polymer X having an average particle size of 78 nm. The summary of Organic-Inorganic Hybrid Polymers A to V and X above is shown in Table 2 below.

TABLE 2

| | Raw material for polymer | Organic-inorganic hybrid polymer as product | Kind of M | Structure of $R^1$ | Ion exchange group contained in $R^2$, $R^3$, $R^4$ or $R^5$ | Average particle size nm |
|---|---|---|---|---|---|---|
| Synthesis Example A | Polymer 1 | Polymer A | Si | (2) Formula | Sulfonate group | 79 |
| Synthesis Example B | Polymer 1 | Polymer B | Si | (2) Formula | Phosphate group | 81 |
| Synthesis Example D | Polymer 1 | Polymer D | Si | (2) Formula | Quaternary ammonium group | 81 |
| Synthesis Example E | Polymer 2 | Polymer E | Si | (3) Formula | Sulfonate group | 78 |
| Synthesis Example F | Polymer 3 | Polymer F | Si | (3) Formula | Sulfonate group | 80 |
| Synthesis Example G | Polymer 4 | Polymer G | Si | (3) Formula | Sulfonate group | 81 |
| Synthesis Example H | Polymer 3 | Polymer H | Si | (3) Formula | Sulfonate group | 498 |
| Synthesis Example I | Polymer 3 | Polymer I | Si | (3) Formula | Sulfonate group | 47 |
| Synthesis Example J | Polymer 5 | Polymer J | Ti | (3) Formula | Sulfonate group | 81 |
| Synthesis Example K | Polymer 6 | Polymer K | Zr | (3) Formula | Sulfonate group | 78 |
| Synthesis Example L | Polymer 7 | Polymer L | Hf | (3) Formula | Sulfonate group | 82 |
| Synthesis Example M | Polymer 3 | Polymer M | Si | (3) Formula | Phosphate group | 79 |
| Synthesis Example O | Polymer 8 | Polymer O | Si | (4) Formula | Sulfonate group | 78 |
| Synthesis Example P | Polymer 8 | Polymer P | Si | (4) Formula | Phosphate group | 82 |
| Synthesis Example R | Polymer 9 | Polymer R | Si | (5) Formula | Sulfonate group | 77 |
| Synthesis Example S | Polymer 9 | Polymer S | Si | (5) Formula | Phosphate group | 81 |
| Synthesis Example T | Polymer 9 | Polymer T | Si | (5) Formula | Carboxyl group | 82 |
| Synthesis Example U | Polymer 10 | Polymer U | Si | (6) Formula | Sulfonate group | 79 |
| Synthesis Example V | Polymer 10 | Polymer V | Si | (6) Formula | Phosphate group | 82 |
| Synthesis Example X | — | Polymer X | Si | (4) Formula | Sulfonate group | 78 |

Example 1

By the following operation, a charging roller was produced and evaluated.

(1. Preparation of Rubber Composition)

Materials shown in Table 3 were mixed by an open roll mill to prepare an unvulcanized rubber composition.

TABLE 3

| Raw material | Amount to be used (parts by mass) |
|---|---|
| Terpolymer of 40 mol % of epichlorohydrin-56 mol % of ethylene oxide-4 mol % of allyl glycidyl ether | 100 |
| Zinc oxide (two kinds of zinc oxide, made by Seido Chemical Industry Co., Ltd.) | 5 |

TABLE 3-continued

| Raw material | Amount to be used (parts by mass) |
|---|---|
| Polymer A | 20 |
| Calcium carbonate (trade name: Silver W: made by Shiraishi Calcium Kaisha, Ltd.) | 35 |
| Carbon black (trade name: SEAST SO: made by Tokai Carbon Co., Ltd.) | 8 |
| Stearic acid (processing aid) | 2 |
| Adipic acid ester (trade name: POLYCIZER W305 ELS: made by Nippon Inki Kagakukogyo) (plasticizer) | 10 |
| Sulfur (vulcanizing agent) | 0.5 |
| Dipentamethylenethiuram tetrasulfide (trade name: NOCCELER TRA: made by Ouchi Shinko Chemical Industrial Co., Ltd.) (crosslinking aid) | 2 |

(2. Formation of Conductive Layer)

As a conductive mandrel (core metal), a cylindrical rod having a length of 252 mm and an outer diameter of 6 mm was prepared, with the surface of free cutting steel being subjected to electroless nickel plating. Using a roll coater, a conductive hot-melt adhesive was applied to a portion of the core metal having a length of 230 mm except each end having a length of 11 mm.

Next, a crosshead extruder having a feeding mechanism for a core metal and a discharging mechanism for a roller was prepared. A die having an inner diameter of 9.0 mm was attached to the crosshead. The temperatures of the extruder and the crosshead were adjusted to 80° C., and the conveying speed of the core metal was adjusted to 60 mm/sec. On this condition, an unvulcanized rubber composition was fed from the extruder to obtain a core metal having a surface coated with the unvulcanized rubber composition. Next, the core metal having coated with the unvulcanized rubber composition was placed into a 170° C. hot-air vulcanizing furnace, and heated for 60 minutes. Then, the ends of the conductive layer were cut and removed such that the conductive layer might have a length of 228 mm. Finally, the surface of the conductive layer was polished by a grinding wheel. Thereby, a conductive elastic roller was obtained in which a portion 90 mm from the central portion to one end and a portion 90 mm from the central portion to the other end each had a diameter of 8.4 mm, and the central portion had a diameter of 8.5 mm.

(3. Formation of Surface Layer)

Methyl isobutyl ketone was added to a caprolactone-modified acrylic polyol solution, and the solution was adjusted such that the solid content might be 18% by mass. The following components were added based on 100 parts by mass of the solid content in the solution to prepare a mixed solution: 16 parts by mass of carbon black (HAF), 35 parts by mass of acicular rutile titanium oxide fine particles (surface treated with hexamethylenedisilazane and dimethyl silicone, average particle size of 0.015 μm, length:width=3:1), 0.1 parts by mass of modified dimethyl silicone oil, and 80.14 parts by mass of a mixture of butanone oxime-blocked hexamethylene diisocyanate (HDI) and butanone oxime-blocked isophorone diisocyanate (IPDI) at 7:3. At this time, the mixture of blocked HDI and blocked IPDI was added such that "NCO/OH=1.0". In the 450-mL glass bottle, 210 g of the mixed solution and 200 g of glass beads having an average particle size of 0.8 mm as a medium were mixed, and dispersed for 24 hours using a paint shaker disperser. After dispersion, 5.44 g (equivalent to 20 parts by mass based on 100 parts by mass of acrylic polyol) of a crosslinking acrylic particle "MR50G" (trade name, made by Soken Chemical & Engineering Co., Ltd.) was added as a resin particle. Then, the solution was further dispersed for 30 minutes or longer to obtain a coating material for forming a surface layer. The conductive elastic roller was dip coated with the coating material once. The coating material was dried at room temperature for 30 minutes by the air, then dried by a hot-air circulating dryer set at 90° C. for 1 hour, and further dried by the hot-air circulating dryer set at 160° C. for 1 hour. Thus, a surface layer was formed on the outer periphery of the conductive layer. At a dipping time in the dip coating of 9 sec, the withdrawing speed in the dip coating was adjusted such that the initial stage speed might be 20 mm/s and the final speed might be 2 mm/s, and the speed between 20 mm/s and 2 mm/s was changed linearly to the time. Thus, a charging roller was produced having the surface layer on the outer periphery of the conductive layer. The evaluation results are shown in Table 8.

Examples 2 to 6

The charging roller was produced in the same manner as in Example 1 except that instead of Organic-Inorganic Hybrid Polymer A, an organic-inorganic hybrid polymer shown in Table 4 was used.

TABLE 4

| | Organic-inorganic hybrid polymer |
|---|---|
| Example 2 | Polymer B |
| Example 3 | Polymer D |
| Example 4 | Polymer E |
| Example 5 | Polymer F |
| Example 6 | Polymer G |

Examples 7 and 8

The charging roller was produced in the same manner as in Example 1 except that instead of Organic-Inorganic Hybrid Polymer A, Organic-Inorganic Hybrid Polymer H and I respectively was used.

Examples 9 and 10

The charging roller was produced in the same manner as in Example 1 except that the amount of Organic-Inorganic Hybrid Polymer A was changed from 20 parts by mass in Example 1 to 8 parts by mass or 50 parts by mass.

Example 11

The charging roller was produced in the same manner as in Example 1 except that the surface layer in Example 1 was not formed.

Examples 12 to 21

The charging roller was produced in the same manner as in Example 1 except that instead of Organic-Inorganic Hybrid Polymer A, an organic-inorganic hybrid polymer shown in Table 5 was used.

TABLE 5

| | Organic-inorganic hybrid polymer |
|---|---|
| Example 12 | Polymer J |
| Example 13 | Polymer K |
| Example 14 | Polymer L |
| Example 15 | Polymer M |
| Example 16 | Polymer O |
| Example 17 | Polymer P |
| Example 18 | Polymer R |
| Example 19 | Polymer S |
| Example 20 | Polymer U |
| Example 21 | Polymer V |

Example 22

The charging roller was produced in the same manner as in Example 1 except that the rubber composition in Example 1 was replaced by the composition shown in Table 6, and 16 parts by mass of carbon black (HAF) in the surface layer was replaced by 25 parts by mass of Organic-Inorganic Hybrid Polymer F.

TABLE 6

| Raw material | Amount to be used (parts by mass) |
|---|---|
| NBR (trade name: "Nipol DN219": made by ZEON Corporation | 100 |
| Carbon black 1 (trade name "Asahi HS-500": made by Asahi Carbon Co., Ltd.) | 14 |
| Carbon black 2 (trade name "KETJENBLACK EC600JD": made by Lion Corporation) | 4 |
| Zinc Stearate (processing aid) | 1 |
| Zinc oxide (two kinds of zinc oxide, made by Seido Chemical Industry Co., Ltd.) | 5 |
| Calcium carbonate (trade name "NANOX #30": made by Maruo Calcium Co., Ltd.) | 20 |
| Dibenzothiazolyl disulfide (trade name "NOCCELER-DM-P": made by Ouchi Shinko Chemical Industrial Co., Ltd.) | 1 |
| Tetrabenzylthiuram disulfide (trade name "Perkacit TBzTD": made by Flexsys) | 3 |
| Sulfur (vulcanizing agent) | 1.2 |

Example 23

The charging roller was produced in the same manner as in Example 1 except that instead of Organic-Inorganic Hybrid Polymer A, Organic-Inorganic Hybrid Polymer X was used.

Comparative Examples 1 and 2

The charging roller was produced in the same manner as in Example 1 except that instead of Organic-Inorganic Hybrid Polymer A, silica (particle size of 75 nm) or Polymer 3 was used.

Comparative Example 3

The charging roller was produced in the same manner as in Example 1 except that the rubber composition in Example 1 was replaced by the composition shown in Table 7.

TABLE 7

| Raw material | Amount to be used (parts by mass) |
|---|---|
| Terpolymer of 40 mol % of epichlorohydrin-56 mol % of ethylene oxide-4 mol % of allyl glycidyl ether | 100 |
| Zinc oxide (two kinds of zinc oxide, made by Seido Chemical Industry Co., Ltd.) | 5 |
| Tetramethylammonium perchlorate (ion conductive agent) | 1 |
| Calcium carbonate (trade name: Silver W: made by Shiraishi Calcium Kaisha, Ltd.) | 55 |
| Carbon black (trade name: SEAST SO: made by Tokai Carbon Co., Ltd.) | 8 |
| Stearic acid (processing aid) | 2 |
| Adipic acid ester (trade name: POLYCIZER W305 ELS: made by Nippon Inki Kagakukogyo) (plasticizer) | 10 |
| Sulfur (vulcanizing agent) | 0.5 |
| Dipentamethylenethiuram tetrasulfide (trade name: NOCCELER TRA: made by Ouchi Shinko Chemical Industrial Co., Ltd.) (crosslinking aid) | 2 |

The evaluation results of the charging rollers of Examples 1 to 23 and Comparative Examples 1 to 3 are shown in Table 8.

TABLE 8

| | (1) Electric resistance value | | | | Evaluation rank of image | |
|---|---|---|---|---|---|---|
| | At initial stage | | After durability test | | (2) | (3) |
| | Electric resistance value (Ω) | Evaluation rank | Electric resistance value (Ω) | Evaluation rank | At initial stage | After durability test |
| Example 1 | 8.89E+04 | A | 9.60E+04 | A | A | A |
| Example 2 | 1.82E+05 | B | 1.95E+05 | B | B | B |
| Example 3 | 9.17E+04 | A | 9.91E+04 | A | A | A |
| Example 4 | 9.09E+04 | A | 9.73E+04 | A | A | A |
| Example 5 | 9.13E+04 | A | 9.86E+04 | A | A | A |
| Example 6 | 1.54E+05 | B | 1.68E+05 | B | B | B |
| Example 7 | 1.33E+05 | B | 1.47E+05 | B | B | B |
| Example 8 | 9.05E+04 | A | 9.95E+04 | A | A | A |
| Example 9 | 1.67E+05 | B | 1.87E+05 | B | B | B |
| Example 10 | 8.00E+04 | A | 8.88E+04 | A | A | A |
| Example 11 | 9.30E+04 | A | 9.86E+04 | A | A | A |
| Example 12 | 9.01E+04 | A | 9.64E+04 | A | A | A |
| Example 13 | 8.99E+04 | A | 9.80E+04 | A | A | A |
| Example 14 | 9.17E+04 | A | 9.91E+04 | A | A | A |
| Example 15 | 1.74E+05 | B | 1.95E+05 | B | B | B |
| Example 16 | 9.09E+04 | A | 9.82E+04 | A | A | A |
| Example 17 | 1.60E+05 | B | 1.74E+05 | B | B | B |
| Example 18 | 9.13E+04 | A | 9.77E+04 | A | A | A |
| Example 19 | 1.67E+05 | B | 1.87E+05 | B | B | B |
| Example 20 | 9.17E+04 | A | 9.91E+04 | A | A | A |
| Example 21 | 1.74E+05 | B | 1.97E+05 | B | B | B |

TABLE 8-continued

| | (1) Electric resistance value | | | | Evaluation rank of image | |
|---|---|---|---|---|---|---|
| | At initial stage | | After durability test | | (2) | (3) |
| | Electric resistance value (Ω) | Evaluation rank | Electric resistance value (Ω) | Evaluation rank | At initial stage | After durability test |
| Example 22 | 9.30E+04 | A | 9.77E+04 | A | A | A |
| Example 23 | 8.85E+04 | A | 9.82E+04 | A | A | A |
| Comparative Example 1 | 4.76E+05 | D | 4.86E+05 | D | D | D |
| Comparative Example 2 | 4.88E+05 | D | 5.02E+05 | D | D | D |
| Comparative Example 3 | 8.77E+04 | B | 5.11E+05 | D | B | D |

Example 24

A developing roller was produced by the following procedure, and evaluated.

(1. Preparation of Rubber Composition)

The respective materials shown in Table 3 were mixed by an open roll mill in the same manner as in Example 1 to obtain an unvulcanized rubber composition.

(2. Formation of Conductive Layer)

As a conductive mandrel (core metal), a core metal having a length of 279 mm and an outer diameter of 6 mm was prepared, with the surface of free cutting steel being subjected to electroless nickel plating. Using a roll coater, a conductive hot-melt adhesive was applied to a portion of the core metal (233 mm) except each end having a length of 23 mm.

Next, a crosshead extruder having a feeding mechanism for a core metal and a discharging mechanism for a roller was prepared. A die having an inner diameter of 13.0 mm was attached to the crosshead. The temperatures of the extruder and the crosshead were adjusted to 80° C., and the conveying speed of the core metal was adjusted to 120 mm/sec. On this condition, an unvulcanized rubber composition was fed from the extruder to obtain a core metal having a surface coated with the unvulcanized rubber composition.

Next, the core metal having coated with the unvulcanized rubber composition was placed into a 170° C. hot-air vulcanizing furnace, and heated for 60 minutes. Then, the ends of the conductive layer were cut and removed such that the conductive layer might have a length of 235 mm. Finally, the surface of the conductive layer was polished by a grinding wheel. Thereby, a conductive elastic roller was obtained in which the central portion had a diameter 12.0 mm.

(3. Formation of Surface Layer)

100 parts by mass of polyol (trade name: NIPPOLAN 5196; made by Nippon Polyurethane Industry Co., Ltd.) as a solid content, 4 parts by mass of a curing agent (trade name: CORONATE L; made by Nippon Polyurethane Industry Co., Ltd.) as a solid content, and 22 parts by mass of a conductive agent (trade name: MA11; made by Mitsubishi Chemical Corporation) were prepared.

These were added to methyl ethyl ketone such that these solid content might be 9.5% by mass. The solution was sufficiently stirred to obtain a coating material for forming a surface layer. The conductive elastic roller was dip coated with the coating material once. The coating material was dried at room temperature for 30 minutes or longer by the air, and then dried by a hot-air circulating dryer set at 145° C. for 1 hour to form a surface layer on the outer periphery of the conductive layer. Thus, a developing roller was produced.

Examples 25 to 28

The developing roller was produced in the same manner as in Example 24 except that instead of Organic-Inorganic Hybrid Polymer A, an organic-inorganic hybrid polymer shown in Table 9 was used.

Comparative Example 4

The developing roller was produced in the same manner as in Example 24 except that instead of Organic-Inorganic Hybrid Polymer A, the same rubber composition (see Table 7) as that in Comparative Example 3 was used.

The evaluation results of Examples 24 to 28 and Comparative Example 4 are shown in Table 9.

TABLE 9

| | Organic-inorganic hybrid polymer in conductive layer | | Evaluation of developing roller | |
|---|---|---|---|---|
| | Kind | Amount to be used (parts by mass) | Evaluation of image | Evaluation of image after durability test |
| Example 24 | Polymer A | 20 | A | A |
| Example 25 | Polymer E | 20 | A | A |
| Example 26 | Polymer P | 20 | A | B |
| Example 27 | Polymer T | 20 | B | B |
| Example 28 | Polymer U | 20 | A | A |
| Comparative Example 4 | — | | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2010-150562, filed on Jun. 30, 2010, the content of which is incorporated herein by reference as part of this application.

What is claimed is:

1. A process cartridge composed so as to be detachable to a main body of an electrophotographic image forming apparatus, the process cartridge comprising a charging member for electrophotography as a charging roller or developing roller, wherein the charging member comprises:

a conductive mandrel; and a conductive layer provided on an outer periphery of the conductive mandrel, wherein the conductive layer comprises:

an organic polymeric compound as a binder; and a conductive particle dispersed in the binder, and wherein the conductive particle consists of an organic-inorganic hybrid polymer, and the organic-inorganic hybrid polymer has a structure represented by the following formula (1):

(1)

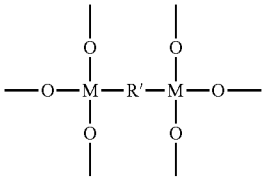

wherein $R^1$ represents an organic group having an ion exchange group; and M represents silicon, titanium, zirconium or hafnium.

2. The process cartridge according to claim 1, wherein the $R^1$ in the formula (1) is an organic group represented by the following formula (2):

(2)

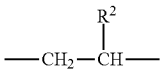

wherein $R^2$ represents an organic group having a sulfonate group, a phosphate group, a carboxyl group or a quaternary ammonium group.

3. The process cartridge according to claim 1, wherein the $R^1$ is one of organic groups represented by the following formulas (3), (4), (5) and (6):

(3)

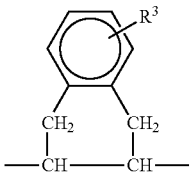

(4)

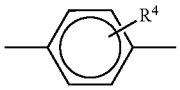

(5)

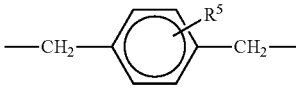

(6)

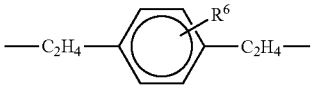

wherein $R^3$, $R^4$, $R^5$ and $R^6$ each independently represent an organic group having a sulfonate group, a phosphate group or a carboxyl group.

4. The process cartridge according to claim 1, wherein the organic-inorganic hybrid polymer is synthesized by preparing a hydrolyzed condensate of a hydrolytic compound containing at least one selected from the group consisting of compounds represented by the following formulas (7), (8), (9) and (10):

$$(OR)_3Si—R^7—Si(OR)_3 \quad (7)$$

$$(OR)_3Ti—R^7—Ti(OR)_3 \quad (8)$$

$$(OR)_3Zr—R^7—Zr(OR)_3 \quad (9)$$

$$(OR)_3Hf—R^7—Hf(OR)_3 \quad (10)$$

wherein $R^7$ represents an organic group that can be converted into the $R^1$ by introducing the ion exchange group into $R^7$, and R each independently represents a hydroxyl group or an alkyl group having 1 to 4 carbon atoms.

5. An electrophotographic image forming apparatus comprising a charging member for electrophotography as a charging roller or developing roller, wherein the charging member comprises:

a conductive mandrel; and a conductive layer provided on an outer periphery of the conductive mandrel, wherein the conductive layer comprises:

an organic polymeric compound as a binder; and a conductive particle dispersed in the binder, and wherein the conductive particle consists of an organic-inorganic hybrid polymer, and the organic-inorganic hybrid polymer has a structure represented by the following formula (1):

(1)

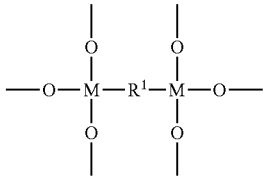

wherein $R^1$ represents an organic group having an ion exchange group; and M represents silicon, titanium, zirconium or hafnium.

6. The electrophotographic image forming apparatus according to claim 5, wherein the $R^1$ in the formula (1) is an organic group represented by the following formula (2):

(2)

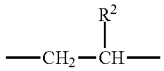

wherein $R^2$ represents an organic group having a sulfonate group, a phosphate group, a carboxyl group or a quaternary ammonium group.

7. The electrophotographic image forming apparatus according to claim 5, wherein the $R^1$ is one of organic groups represented by the following formulas (3), (4), (5) and (6):

(3)

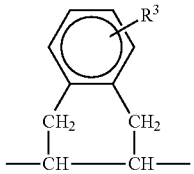

(4)

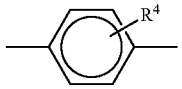

(5)

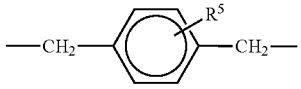

-continued (6)

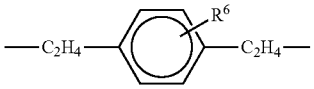

wherein $R^3$, $R^4$, $R^5$ and $R^6$ each independently represent an organic group having a sulfonate group, a phosphate group or a carboxyl group.

8. The electrophotographic image forming apparatus according to claim 5, wherein the organic-inorganic hybrid polymer is synthesized by preparing a hydrolyzed condensate of a hydrolytic compound containing at least one selected from the group consisting of compounds represented by the following formulas (7), (8), (9) and (10):

$$(OR)_3Si—R^7—Si(OR)_3 \quad (7)$$

$$(OR)_3Ti—R^7—Ti(OR)_3 \quad (8)$$

$$(OR)_3Zr—R^7—Zr(OR)_3 \quad (9)$$

$$(OR)_3Hf—R^7—Hf(OR)_3 \quad (10)$$

wherein $R^7$ represents an organic group that can be converted into the $R^1$ by introducing the ion exchange group into $R^7$, and R each independently represents a hydroxyl group or an alkyl group having 1 to 4 carbon atoms.

* * * * *